United States Patent [19]

Kishimoto et al.

[11] Patent Number: 4,806,973

[45] Date of Patent: Feb. 21, 1989

[54] COLOR IMAGE-FORMING APPARATUS FOR PRODUCING OVERLAPPED MONOCHROME IMAGES

[75] Inventors: Tadao Kishimoto; Toshifumi Isobe; Hiroyuki Maruyama; Jun Yokobori, all of Hachioji, Japan

[73] Assignee: Konishiroku Photo Industry Co., Ltd., Tokyo, Japan

[21] Appl. No.: 220,907

[22] Filed: Jul. 19, 1988

Related U.S. Application Data

[63] Continuation of Ser. No. 934,112, Nov. 24, 1986, abandoned.

[30] Foreign Application Priority Data

Dec. 24, 1985 [JP] Japan ..... 60-296337
Dec. 24, 1985 [JP] Japan ..... 60-296340

[51] Int. Cl.[4] ..... G03G 15/01
[52] U.S. Cl. ..... 355/4; 355/15
[58] Field of Search ..... 355/4, 15

[56] References Cited

U.S. PATENT DOCUMENTS 4,106,870 8/1978 Kondo et al. ..... 355/4
4,165,165 8/1979 Iwami et al. ..... 355/4
4,571,071 2/1986 Bothner ..... 355/15
4,639,124 1/1987 Nye et al. ..... 355/15
4,664,504 5/1987 Oda et al. ..... 355/15
4,669,864 6/1987 Shoji et al. ..... 355/15

FOREIGN PATENT DOCUMENTS 192710 10/1085 Japan .
181362 10/1984 Japan .
192711 10/1985 Japan .

*Primary Examiner*—Patrick R. Salce
*Assistant Examiner*—Jeffrey Sterrett
*Attorney, Agent, or Firm*—Frishauf, Holtz, Goodman & Woodward

[57] ABSTRACT

An image forming apparatus for conducting writing and developing operations several times on an image retainer and transferring the developed images to a transfer material. An output of a developing bias power source is sequentially distributed to a plurality of developing devices in the order in which the image retainer moves from an image signal writing device and the beginning of the abutment of a cleaning member against the image retainer and the beginning of the release from the abutment fall at timing other than at least the image writing timing.

17 Claims, 8 Drawing Sheets

Q
1
11
12
13
25°
65°
65°
140mm$^{\phi}$ (UNIT: sec)
7.58
7.58
7.58
1st ROTATION
2nd ROTATION
3rd ROTATION
ROTATIONS OF PHOTOSENSITIVE DRUM
MOVING OPTICAL SYSTEM FORWARD
MOVING OPTICAL SYSTEM BACKWARD
EXPOSURE
TREATMENT USING DEVELOPING DEVICE 11
TREATMENT USING DEVELOPING DEVICE 12
TREATMENT USING DEVELOPING DEVICE 13
$T_1$=0.52
6.27
$T_2$=1.89
1.89
6.27
C
$T_3$=3.26
6.27
D

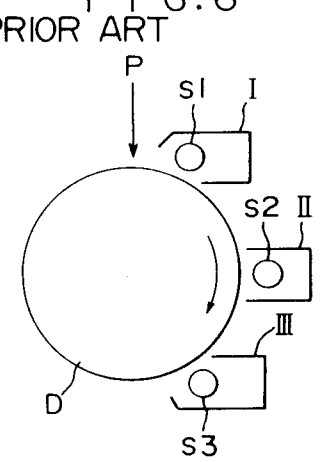
FIG. 6
PRIOR ART
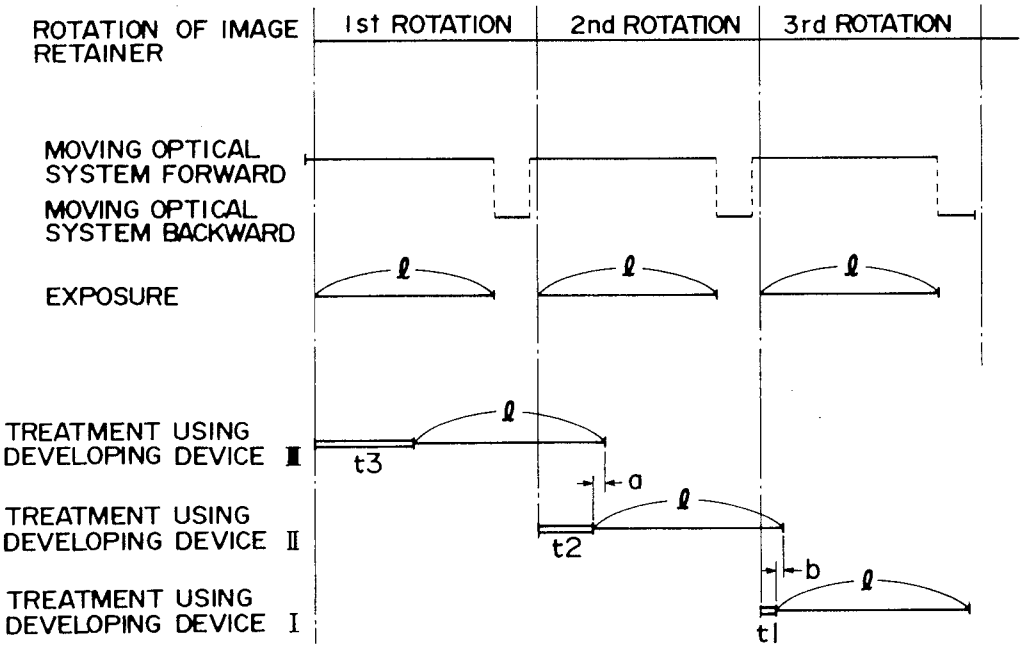
PRIOR ART FIG. 7

FIG. 10(i)
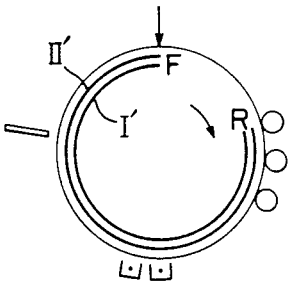
FIG. 10(j)
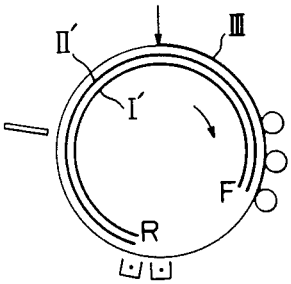
FIG. 10(k)
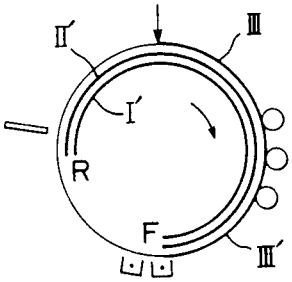
FIG. 10(ℓ)
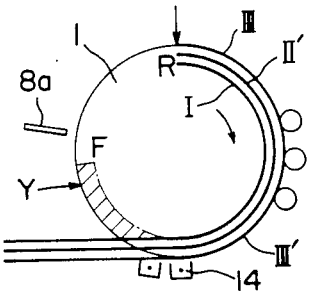
FIG. 10(m)
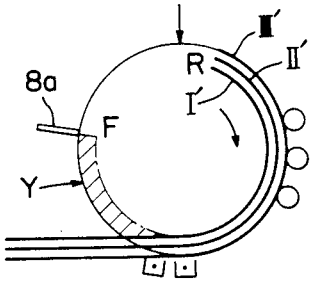
FIG. 10(n)
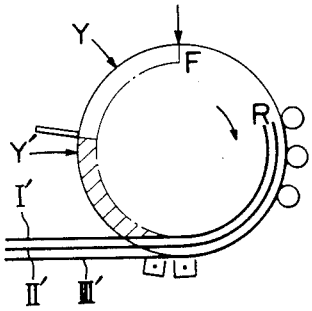

COLOR IMAGE-FORMING APPARATUS FOR PRODUCING OVERLAPPED MONOCHROME IMAGES

This application is a continuation of application Ser. No. 934,112, filed Nov. 24, 1986, now abandoned.

BACKGROUND OF THE INVENTION

1. Field of the Invention

The present invention relates to an image forming apparatus such as a reproducing machine and, more particularly, to a color image forming apparatus of the type for forming an image on an image retainer by writing a plurality of images on the image retainer.

2. Description of the Prior Art

An image forming apparatus for color electrophotography or the like being developed is equipped at the circumferential edge portion of its image retainer with a plurality of developing devices, which are charged with toners of different colors such as red, blue and black colors so as to conduct multicolor developments. Latent images on an image retainer, which are sequentially formed in response to color signals coming from image reading units, are developed to compose a color toner image, which is transferred to a sheet of copy paper or transfer material to obtain a color copy.

If the latent images corresponding to the specified colors are formed on the image retainer by that developing treatment, a strong bias voltage is applied between the image retainer and the developing device charged with a developer of the above-specified color, i.e. a carrier and a toner of the specified color so that the toner of the specified color held by a developing sleeve in the developing device is transferred to the side of the image retainer.

On the other hand, since the image retainer is a drum-shaped member having a large capacity, as is well known in the art, it is desired to have its external diameter made as small as possible in not only the color type image forming apparatus but also a general image forming apparatus. Generally speaking, it is desired to make the length of the outer circumference of the image retainer slightly longer than the length of the maximum document to be used. If this desire is satisfied, it is possible to reduce the size of the image forming apparatus and to establish a quick copying cycle for continuous copies without specifically increasing the circumferential velocity.

Since, however, the image forming apparatus of the aforementioned color type has its developing devices of developers of the individual colors arranged in the direction of rotations of the image retainer, there follow respective time differences between the beginning and end of the development of each developing device with respect to the rotational period of the image retainer. Unless, therefore, the setting of the order of the developing devices for the development by applying bias voltages is proper, the timings at which the developing operations are required occur simultaneously for the two developing devices so that, while one developing device is developing the trailing end portion of a latent image, the other developing device develops the leading end portion of the latent image.

As shown in FIG. 6, more specifically, the construction is made such that individual developing devices I, II and III are arranged with respect to an image retainer D rotating in the direction of arrow. With this construction arrangement, the time periods for the image retainer D to reach individual developing sleeves s1, s2 and s3 from an exposure point P are designated at t1, t2 and t3, respectively, and the developing treatments are set in the order of the developing devices III→II→I. A time chart for the developing treatments according to the rotations of the image retainer is shown in FIG. 7, from which it is found that the timing for beginning the developing treatment is made gradually earlier to establish the timings where development processes with toners of two colors have to be conducted simultaneously, as indicated at a and b.

For producing a color copy on a sheet of recording paper, for example, according to another method: the colors of an image are separated; toner images of separated individual single colors are transferred to and fixed on sheets of recording paper; and these sheets of recording paper once copied are fed again so that subsequent toner image of single colors separated are superposed on a sheet of recording paper. However, the color copy thus obtained cannot avoid a drop of the copy quality and an offset of the image and still has a remarkably low copying speed per one sheet.

According to still another method, on the other hand, an intermediate member is provided in addition to an image retainer so that color toner images of individual colors are transferred to and fixed on a sheet of recording paper after they have been superposed on the intermediate member. This method cannot avoid an increase in the size of an image forming apparatus itself therefor and a complicated mechanism of the apparatus.

As image forming apparatus that are free from those defects, we have made proposals which are disclosed in detail in Japanese Patent Laid-Open No. 59-181362 (1984) and Japanese Patent Applications Nos. 60-192710 (1985) and 60-192711 (1985).

After having been transferred to a transfer material or a sheet of recording paper, a toner image has its residual toner peeled and removed therefrom as in an existing image forming apparatus by the action of a cleaning device. Since, however, the cleaning action is conducted by the pressure contact (including the abutment) of a blade member of another cleaning member with an image forming surface, as is well known in the art, it cannot be undergone during the formation or before the transfer of the toner image. In the meanwhile, therefore, the cleaning member is held in a position spaced from an image retainer so that the aforementioned pressure contact of the blade member is started immediately before the leading end of the toner image having been transferred reaches the cleaning device and is released immediately after the trailing end of the toner image has passed the same.

Thus, especially in the cleaning device used in the color iamge forming apparatus, the pressure contact and release of the blade member are conducted for the rotational period of the image retainer so that the speed of the rotation of the image retainer is caused to fluctuate more or less by the resultant frictional resistance. As a result, if the pressure contact and release of the blade member are conducted especially while a latent image is being formed on an image forming surface by an exposure, the circumferential speed of the image forming surface varies to cause disturbances due to the discontinuity of the image scanning operation, thus resulting in a deterioration of the image quality. This naturally can also apply to the monochromatic image formation which is accompanied more or less by a similar problem.

SUMMARY OF THE INVENTION

The present invention contemplates to solve and improve the problems described above. Therefore, an object of the present invention is to provide an image forming appartus such as a color type image forming apparatus for forming an image by using a plurality of developing devices, which apparatus is enabled to assure the developing treatments of all the latent images formed, while avoiding overlap of the aforementioned timing of the developing treatments, by means of corresponding individual developing devices respectively, thereby to reproduce a normal color image at all times while avoiding excessive requirements for the capacities of power supplies and power.

The above-specified object of the present invention is achieved by an image forming apparatus for conducting writing and developing operations several times on an image retainer to transfer the developed images to a transfer material, comprising: means for writing an image signal in an image signal in an image retainer; a plurality of developing means each for developing the image retainer having said image signal written thereon with a developer; a developing bias power source; and means for distributing the output of said developing bias power source to said plural developing means, wherein the output of said developing bias power source is sequentially distributed to said developing means in the order to which said image retainer moves from said image signal writing means.

Another object of the present invention is to provide a color image forming apparatus which is improved to solve the aforementioned problems and to form a color image of high quality capable of being reproduced as a color image by eliminating fluctuations in the rotational speed of an image retainer during formation of a latent image by an exposure and also resulting disturbances of an original image.

The above-specified second object of the present invention is achieved by an image forming apparatus for transferring a toner image formed on an image retainer to a transfer material, comprising: write means for writing a latent image in an image retainer on the basis of an image signal; and developing means for developing said image retainer written with said image signal, wherein the beginnings of the abutment of a cleaning member against said image retainer and the release from said abutment fall at timing other than at least said image writing timing; and wherein the circumferential length of said image retainer from the position of said write means over a transfer position to said cleaning member is made larger than the length of the maximum transfer member.

Other objects and features of the present invention will become apparent from the following description taken with refernece to the accompanying drawings.

BRIEF DESCRIPTION OF THE DRAWINGS

FIGS. 6 and 7 are a diagram showing the arrangement of the developing device of the existing example and a time chart showing the processing operations of the same, respectively;

DESCRIPTION OF THE PREFERRED EMBODIMENTS

One embodiment of the image forming apparatus according to the present invention is shown in FIGS. 1 to 5. Incidentally, the general description of the image forming apparatus to be made in the following is also made in detail in Japanese Patent Laid-Open No. 59-181362 and Japanese Patent Applications Nos. 60-192710 and 60-192711, all of which belong to the same applicant.

Figure 1:
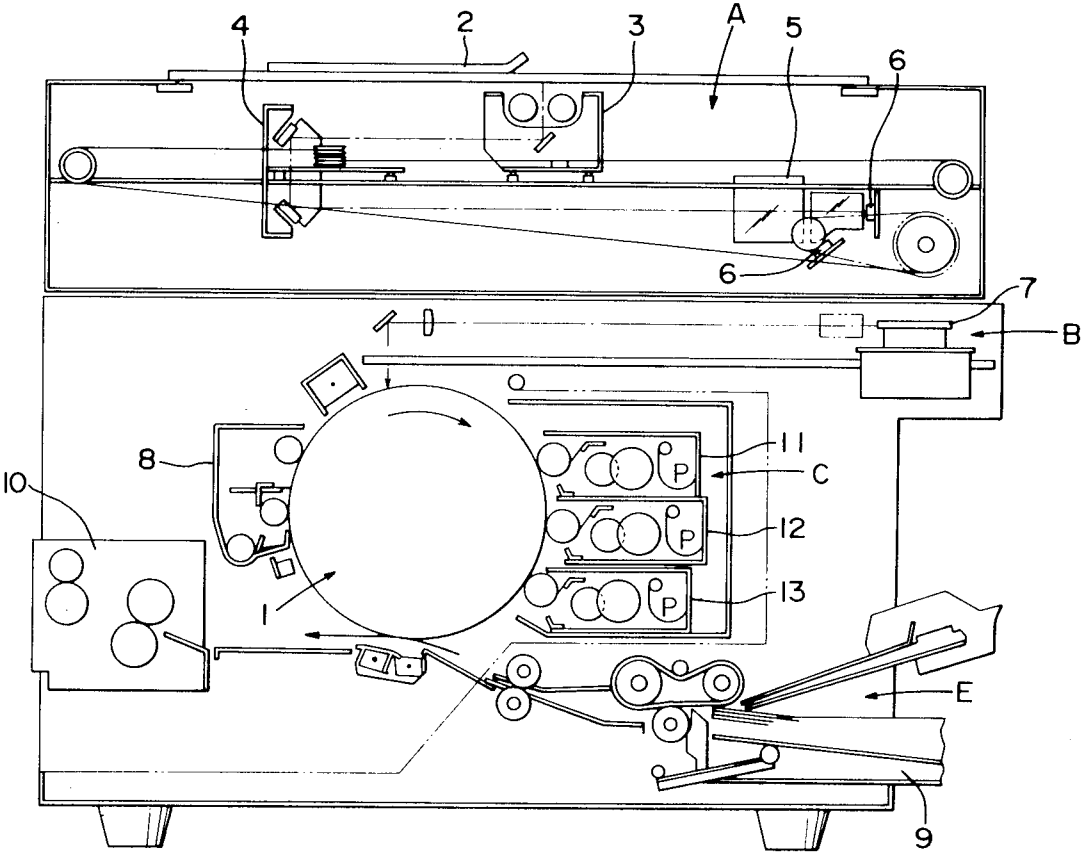
FIG. 1 is a sectional view showing the construction of an image forming apparatus according to the present invention.

In FIG. 1 showing the overall construction of the aforementioned image forming apparatus: reference letter A denotes a read unit for optically exposing and scanning the image of an original document 2 by means of a moving optical system; letter B a write unit acting as write means for writing image signals sent from the read unit A in a photosensitive drum 1 acting as an image retainer to form latent images; letter C a plurality of developing devices acting as developing means provided for forming toner images from the latent images; and letter E a paper feeding unit reserving sheets of recording paper acting as transfer members to which the toner images are to be transferred.

In the read unit A, the document 2 is optically exposed by movable mirror units 3 and 4 of the moving optical system and has its image sent to a lens read unit 5 and separated into a plurality of monochromatic light beams, which are then focused on image sensors 6 made receptive of the respective color images.

The image signals of the respective colors are outputted from the image sensors 6 and are sent to the write unit B so that they are projected on the circumferential surface of the photosensitive drum 1 through an optical system including a polygonal mirror 7 by a laser beam emitted from a semiconductor laser to form scanning lines.

When the scanning operation is started, the laser beam is detected by an index sensor and is started to be modulated with a first color signal to scan the photosensitive drum 1 which has been uniformly charged in advance. A latent image corresponding to the first color is formed on the drum surface by the main scan of the laser beam and by the auxiliary scan of the rotations of the photosensitive drum 1. This latent image is developed by a developing device 11, which is charged with a red toner, for example, to form a toner image on the drum surface. In the present invention, the first developing device 11 to develop the latent image corresponding to that first color is arranged in the closest position to the photosensitive drum 1 in the moving direction of the photosensitive drum 1.

The toner image thus obtained passes, while being retained on the drum surface, below a cleaning device 8, which is spaced from the surface of the photosensitive drum 1, and is charged again to form a second color image like the aforementioned case of the first color signal. This latent image corresponding to the second color signal is developed by a second developing device 12 which is charged with a blue toner, for example. Moreover, a latent image of a third color image is developed by a third developing device 13 which is charged with a black toner, for example. The toner images of those monochromatic colors are composed to form a color toner image. In the present invention, the aforementioned second and third developing devices 12 and 13 are arranged in the specified order downstream of the aforementioned first developing device 11 in the moving direction of the photosensitive drum 1.

The constructions and operations of those developing devices will be described in the following in connection with the developing device 11 shown in FIG. 2. This developing device 11 is composed of a developing sleeve 11*a*, a sponge roller 11*b*, toner agitating rotors 11*c* and 11*d*, an ear cutting plate 11*e*, a developing sleeve 11*f*, and a magnet roll 11*g*. The toner pumped up by the rotations of the toner supply 11*a* is delivered through the sponge roller 11*b* into the developing container, in which it is mixed with a magnetic carrier by the agitations of the toner agitating rotors 11*c* and 11*d*, until the mixture is fed to the developing sleeve 11*f*.

Figure 3:
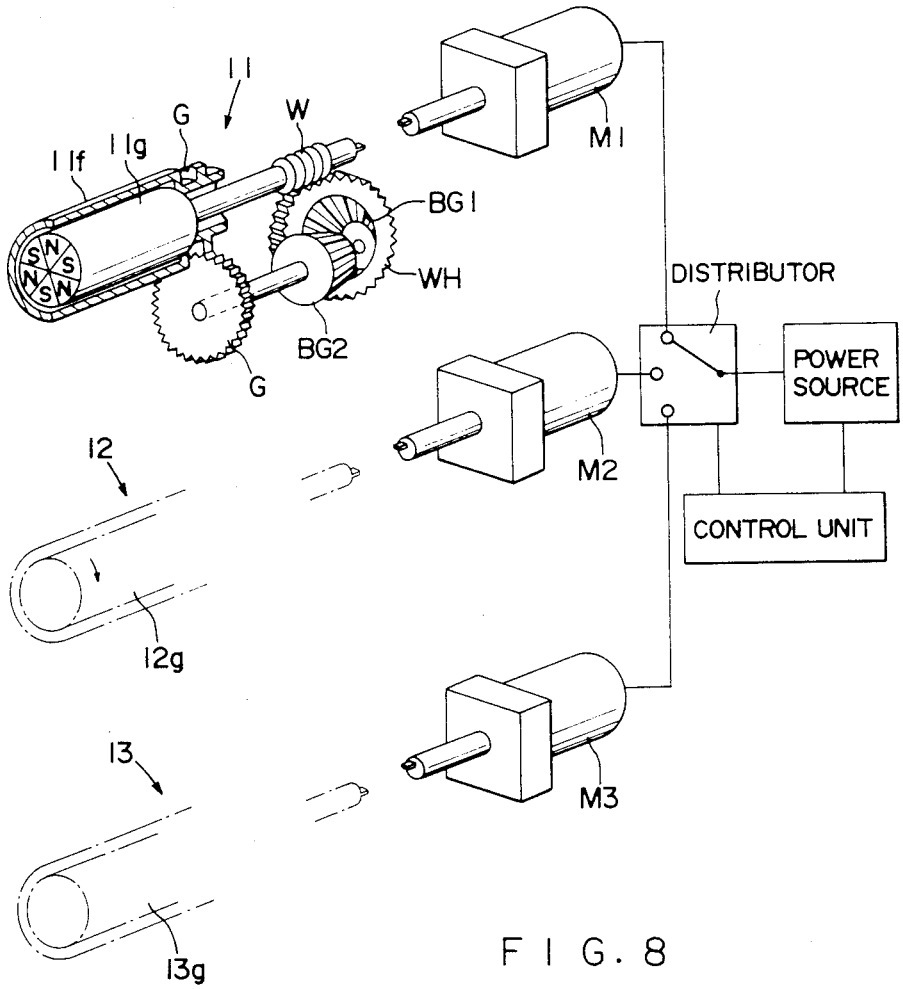
FIG. 3 is a perspective view showing an essential portion of the aforementioned developing device.

This developing sleeve 11*f* is a non-magnetic cylindrical member which is to be rotated in the same counterclockwise direction as the moving direction of the photosensitive drum 1 by the rotational drive of a motor M1 of a drive mechanism shown in FIG. 3. The developing sleeve 11*f* is caused to adsorb the toner in its circumferential surface by the action of the magnet roll 11*g*, which is rotated at a high speed but in the opposite direction by the aforementioned drive mechanism, to retain the toner having a constant thickness regulated by the ear cutting plate 11*e*.

Now, when the formation of the latent image of the first color signal is started, a control signal based thereon is generated to switch a distributor to distribute the outputs of a developing bias power source to the developing device 11 and to turn on the developing bias power source to supply the bias voltage to the aforementioned developing sleeve 11*f*. This bias power source comprises alternate component.

As a result, a noncontact development is conducted with the two-component toner depositing on the developing sleeve 11*f* which is rotating at a small spacing from the latent image on the circumferential surface of the photosensitive drum 1 grounded to the earth.

For this development, the outputs of the developing bias power source, which are switched by the aforementioned distributor on the basis of the control signals generated in synchronism with the formations of the latent images of the second and third color signals, are sequentially acted on the aforementioned developing devices 12 and 13. As a result, the developments are sequentially conducted by the developing devices 12 and 13.

Figure 4:
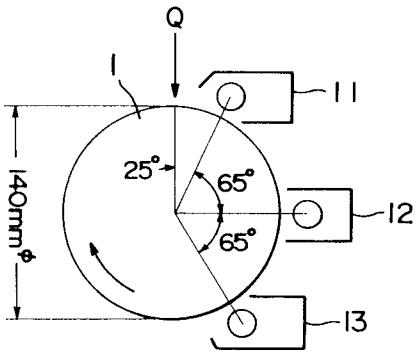
FIGS. 4 and 5 are a diagram showing the arrangement of the aforementioned developing device and a time chart showing the processing operations of the same, respectively.

Next, the case of copying an original document of the maximum B-4 size (having a length of 364 mm) usable will be discussed in the following under the conditions that the external diameter of the photosensitive drum 1 and the arrangements of the developing devices 11, 12 and 13 are set, as shown in FIG. 4 and that the developments are conducted in the order of the developing devices 11→12→13 and in the moving direction (as indicated by an arrow) of the photosensitive drum 1, as has been described above.

Since the photosensitive drum 1 has an outer circumferential length of 140 mm.$\pi$, i.e., about 440 mm, it has a rotational period of 7.58 sec if its circumferential speed is 58 mm/sec. Then, the length l on the circumferential surface of the photosensitive drum 1 from an exposure point Q to the development point of each developing device, i.e., a position to the corresponding developing sleeve, and a time period T required for the movement of the length l are expressed by the following equations:

For the developing device 11:

$$l_1 = 440\ \text{mm} \times 25°/360° = 30.5\ \text{mm};$$

For the developing device 12:

$$l_2 = 440\ \text{mm} \times (25° + 65°)/360° = 110.0\ \text{mm; and}$$

For the developing device 13:

$$l_3 = 440\ \text{mm} \times (25° + 65° + 65°)/360° = 189.4\ \text{mm.}$$

For the developing device 11:

$$T_1 = 30.5\ \text{mm} \div 58\ \text{mm/sec} = 0.52\ \text{sec;}$$

For the developing device 12:

$$T_2 = 110.0\ \text{mm} \div 58\ \text{mm/sec} = 1.89\ \text{sec; and}$$

For the developing device 13:

$$T_3 = 189.4\ \text{mm} \div 58\ \text{mm/sec} = 3.26\ \text{sec.}$$

On the other hand, the time period $T_0$ required for the development is expressed by the following equation because the image of B-4 size has a length of 364 mm:

$$T_0 = 6.27\ \text{sec.}$$

Figure 5:
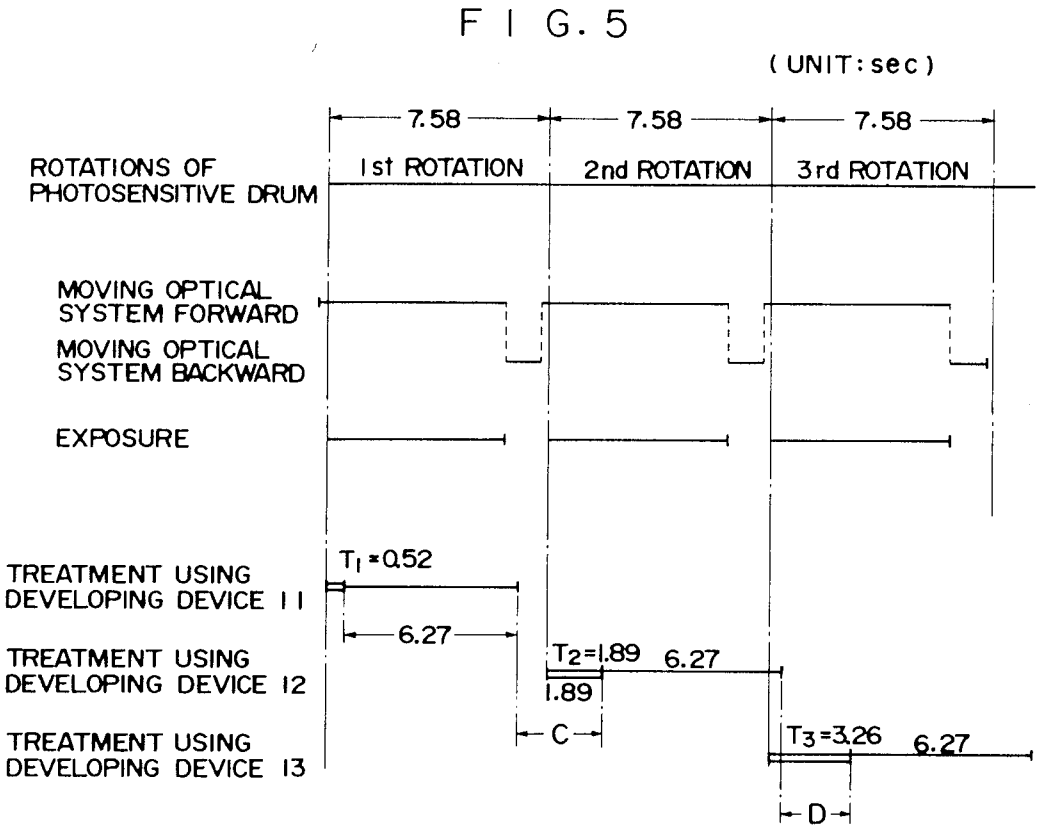

As a result, in view of the developing timings of the respective developing devices, as shown in FIG. 5, a time difference of $C = (7.58 - 0.52 - 6.27) + 1.89 = 2.68$ secs is left between the end of the treatment by the developing device 11 and the beginning of the treatment by the developing device 12, and a time difference of $D = 3.26 - (1.89 + 6.27 - 7.58) = 2.68$ secs is left between those of the developing devices 12 and 13 so that no overlap is produced at the treatments of any developing devices. This makes it possible to switch the aforementioned distributor of the developing bias power source within the aforementioned time difference C or D thereby to execute the desired developing treatments. Incidentally, the aformentioned controls can include not only the output control of the developing bias power source but also the rotation controls of the developing sleeves and/or the magnet rolls.

Figure 8:
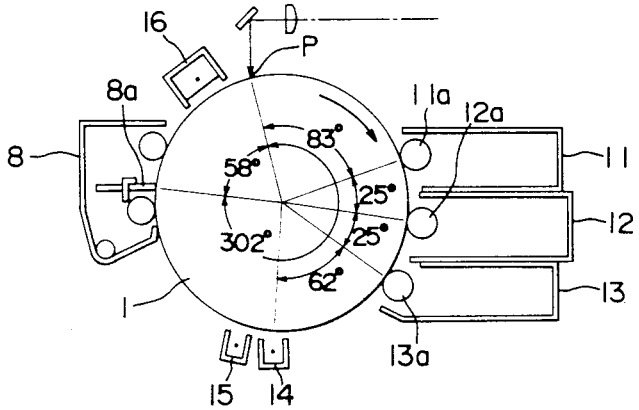
FIG. 8 is a view showing an essential portion of an image forming apparatus according to another embodiment of the present invention.

In succession to the aforementioned developing devices 11, 12 and 13, as shown in FIG. 8, there are arranged in the moving direction of the photosensitive drum 1 transferring and separating electrodes 14 and 15, the aforementioned cleaning device 8, a charging electrode 16, and an exposure point P of the write unit B.

The color toner image formed on the circumferential surface of the photosensitive drum 1 is transferred to a sheet of recording paper delivered from a paper feeding cassette 9. The photosensitive drum 1 has its recording paper separated therefrom and then its residual toner peeled off and cleaned by the blade member 8*a* of the cleaning device 8, which is switched to its pressure contact state. Then, the photosensitive drum 1 is charged again and prepared for a new process of forming the document image.

In respect of both the position of the exposure point P of the aforementioned write unit B with respect to the circumferential edge of the photosensitive drum 1 and the pressure contact position of the blade member 8*a* of the aforementioned cleaning device 8, according to the present invention, the length of the circumferential surface from the exposure point P through the transferring electrode 14 to the pressure contact position of the blade member 8*a* is made slightly larger than the maximum length of the recording paper capable of being transferred, whereas the length of the circumferential surface from the blade member 8*a* through the charging electrode 16 to the exposure point P is made slightly smaller than the minimum copy gap (which has a length corresponding to the non-image region). Here, the description of the cleaning device will be made mainly in connection with the blade member. The present invention should not be limited to the blade member but can be applied to such a cleaning member, e.g., a fur brush or a web as will exert influences upon the rotational speed of the photosensitive member at the beginning and end of the cleaning operation.

Thus, it is possible to obviate the operations of the pressure contact and release of the blade member 8*a* of the cleaning device 8 or the operations of starting and ending the exposure during the cleaning operation. As a result, the respective images corresponding to the individual colors can be projected by the uniform exposures and scans at the stable circumferential speed of the photosensitive drum 1.

Figure 9:
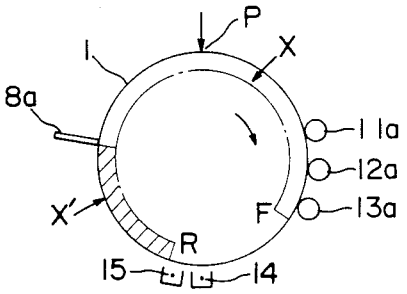
FIGS. 9(*a*) to 9(*h*) and 10(*i*) to 10(*n*) are views of an essential portion and show the respective image forming processes of the present invention.
Figure 9:
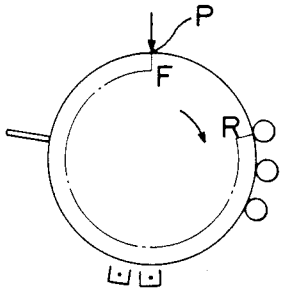
Figure 9:
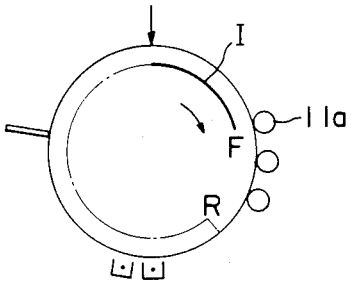
Figure 9:
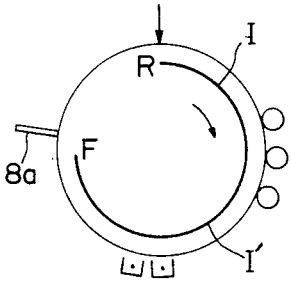
Figure 9:
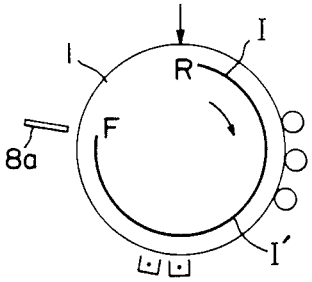
Figure 9:
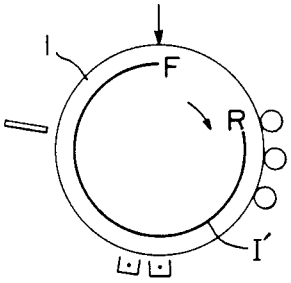
Figure 9:
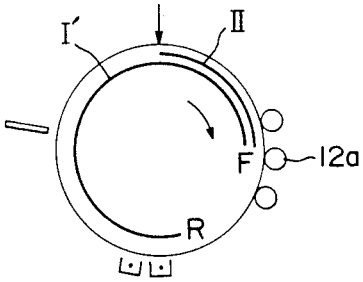
Figure 9:
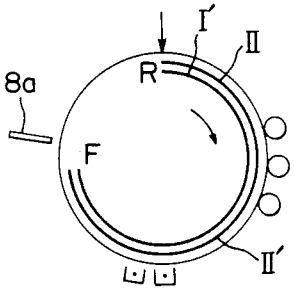

These individual processes will be described with reference to FIGS. 9 and 10. FIG. 9(*a*) shows the step at which a preceding image on the circumferential surface of the photosensitive drum 1 rotating in the direction of arrow has its leading half X subjected to the cleaning action by the blade member 8*a* to have cleaned the residual toner and has its trailing half X′ subjected to the cleaning action. FIG. 9(*b*) shows the state in which an image of a first color corresponding to a subsequent document is to be exposed.

When the latent image I corresponding to the first color is formed by the aforementioned exposure so that its leading end F reaches the position of the developing sleeve 11*a* of the developing device 11 (as shown in FIG. 9(*c*)), it is developed to form a toner image I′. Even at an instant when the exposure of a trailing end R of that latent image I is ended, the leading end F of that toner image I′ is caused not to reach the pressure contact position of the blade member 8*a* yet but to be slightly short (as shown in FIG. 9(*d*)) by the construction of the present invention. In the meanwhile, therefore, the blade member 8*a* is released from its contact pressure to pass over the aforementioned toner image I′ (as shown in FIG. 9(*e*)). As a result, during the formation of the latent image I corresponding to the first color, the aforementioned blade member 8*a* is held in its pressure contact state but not in its operative state so that the photosensitive drum 1 continues its stable rotations at a uniform speed.

Subsequently, the photosensitive drum 1 is charged and then formed with a latent image II corresponding to a second color on the aforementioned toner image I′ (as shown in FIG. 9(*f*)). Likewise, the latent image II has its leading and F reaching the developing sleeve 12*a* of the developing device 12, in which it is developed (as shown in FIG. 9(*g*)) to form a toner image II′. This toner image II′ passes below the blade member 8*a* (as shown in FIG. 9(*h*)). Through a similar process (as shown in FIG. 10(*i*)), again, a latent image III corresponding to a third color and then a corresponding toner image III′ are formed (as shown in FIGS. 10(*j*) and 10(*k*)). This toner image III′ is composed with the aforementioned toner images I′ and II′ to form a multicolor toner image, which is then transferred to the recording paper by the transferring electrode 14. After this, the trailing end R of the latent image III is ended (as shown in FIG. 10(*l*)) before the leading end F of the residual toner of the photosensitive member reaches the position corresponding to the pressure contact of the blade member 8*a*.

As a result, while the latent images II and III corresponding to the second and third colors are being formed, the aforementioned blade member 8*a* is released from its pressure contact but does not start its pressure contact so that the photosensitive drum I can continue its stable rotations at a uniform speed.

Next, before the leading end F of the aforementioned residual toner reaches the blade member 8*a*, this blade member 8*a* comes into its pressure contact state (as shown in FIG. 10(*m*)) so that the residual toner is sequentially removed from its leading half Y to its trailing half Y′. In the case of a continuous copying operation, the charging and exposing operations for a subsequent copy are started without involving any idle rotation of the photosensitive drum 1 (as shown in FIG. 10(*n*)).

Figure 2:
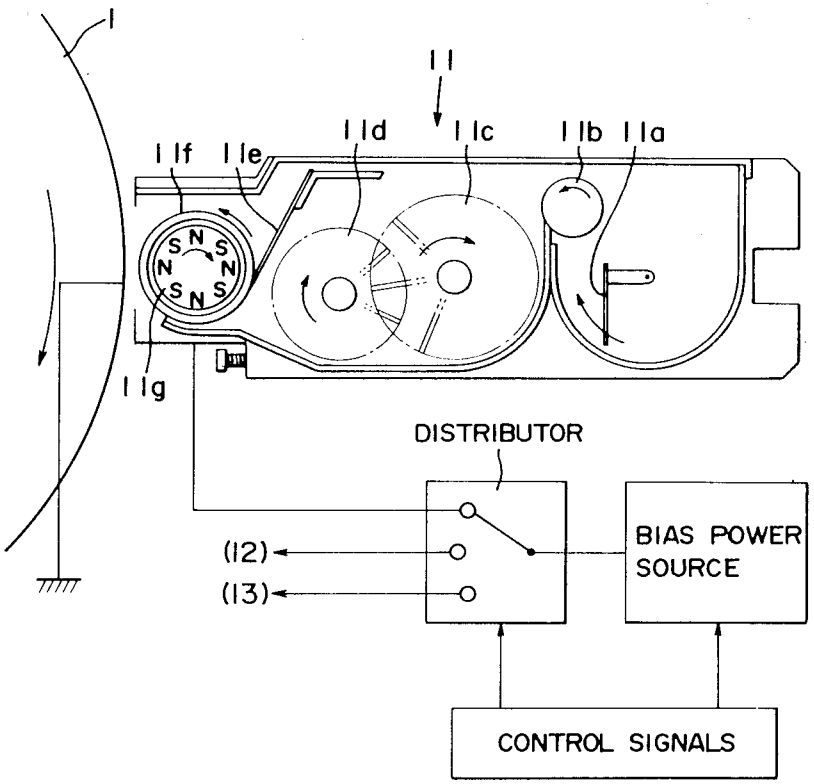
FIG. 2 presents a sectional view showing a developing device belonging to the aforementioned apparatus and a control diagram showing a developing bias power source.

If the external diameter of the outer circumference of the photosensitive drum 1 is set at 140 mm and if the maximum recording paper to be used has a size of B-4 (which has a length of 364 mm), the positions of the exposure point P and the blade member 8*a* satisfying the present invention are set in the following, as shown in FIG. 2:

$$\pi \cdot 140\ \text{mm} \times 302^\circ/360^\circ = 369\ \text{mm} > 364\ \text{mm};\ \text{and}$$

$$\pi \cdot 140\ \text{mm} \times 58^\circ/360^\circ = 71\ \text{mm} < (\pi \cdot 140 - 364)\ \text{mm}.$$

In short, the distance between the exposure point P and the blade member 8*a* is shorter than the non-image portion of the circumferential surface.

Figure 11:
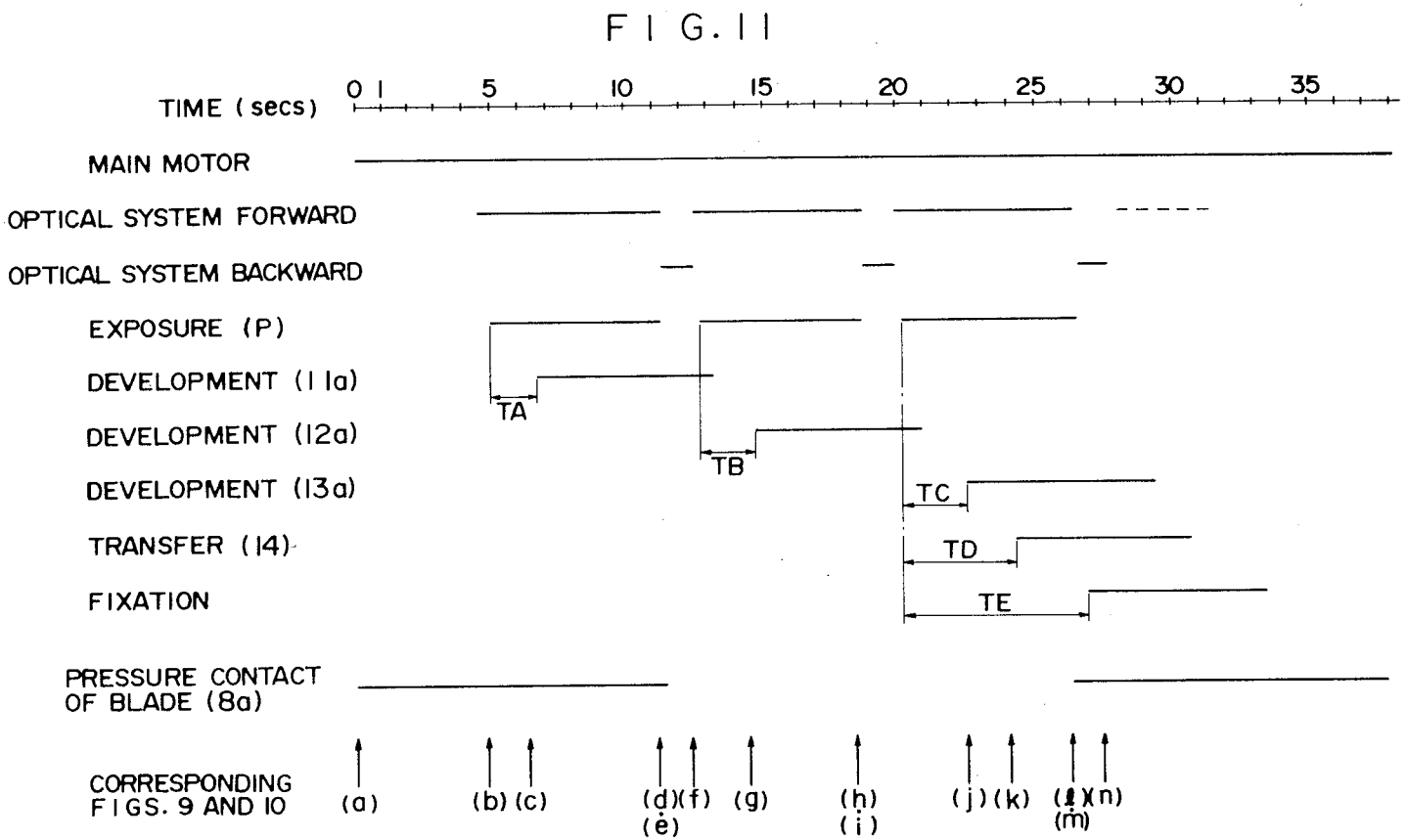
FIG. 11 is a time chart showing those image forming prosesses.

In case the distances to the individual developing devices are set under the above-specified conditions, as shown in FIG. 2, and in case the circumferential speed of the drum is set at 58 mm/sec, the time chart of the aforementioned image forming process is shown in FIG. 11. Specifically, the time periods required to go from an exposure point P to the respective developing sleeves 11*a*, 12*a* and 13*a*, the transferring electrode 14, and a (not-shown) fixing device apart by 150 mm from the transferring electrode 14 are expressed by the following equations:

$$TA = (\pi \cdot 140\ \text{mm}/58\ \text{mm}) \times 83^\circ/360^\circ = 1.75\ (\text{secs});$$

$$TB = (\pi \cdot 140\ \text{mm}/58\ \text{mm}) \times (83^\circ + 25^\circ)/360^\circ = 2.27\ (\text{secs});$$

$$TC=(\pi\cdot 140\ mm/58\ mm)\times(83^\circ+25^\circ+25^\circ)/360^\circ=2.80\ (secs);$$

$$TD=(\pi\cdot 140\ mm/58\ mm)\times(83^\circ+25^\circ+25^\circ+62^\circ)/360^\circ=4.11\ (secs);$$

and $$TE=TD+150\ mm/58\ mm=6.69.$$

By editing the timing for the respective development processes of the plural developing devices by making use of the time differences coming from the differences of the arranged positions of the repsective developing devices relative to the image retainer, according to the present invention, it is possible to provide an image forming apparatus in which the aforementioned respective developing operations can always be executed independently and completely, while precluding any excessive load on the power source, to reliably form desired color copies at all times.

Since, moreover, neither the pressure contact nor the release of the cleaning device such as the blade member are not started during the exposure of the document image, i.e., during the writing operations of the latent images, according to the present invention, the images corresponding to the individual colors can be exposed all over the image surface under the conditions of the respectively constant rotational speeds of the photosensitive drum, thus providing an image forming apparatus which can form a color or monochromatic transfer image of high quality without any distorsion and disturbance.

What is claimed is:

1. In an image forming apparatus for conducting writing and developing operations several times on an image retainer to transfer the developed images to a transfer material, comprising: means for writing an image signal in an image retainer; a plurality of developing means each for developing the image retainer having said image signal written thereon with a developer; a developing bias power source; means for distributing the output of said developing bias power source to said plural developing means; means for transferring a toner image on a transfer material; and means for cleaning a residual toner on the image retainer, the improvement characterized in that the output of said developing bias power source is sequentially distributed to said developing means in the order in which said image retainer moves from said image signal writing means and that the beginning of the abutment of a cleaning member against said image retainer and the beginning of the release from said abutment fall at timing other than at least said image writing timing.

2. An image forming apparatus according to claim 1, wherein said developing means have developing sleeves and/or magnet rolls rotating while they are receiving the distributions.

3. An image forming apparatus according to claim 1, wherein the circumferential length of said image retainer from the position of said write means over a transfer position to said cleaning member is made longer than a maximum expected length for said transfer material.

4. An image forming apparatus according to claim 3, wherein said plurality of developing means includes a plurality of developing devices for accommodating toners of different colors, and wherein said write means and said plurality of developing means operate several times before said transfer to form toner images of plural colors on an image retainer.

5. An image forming apparatus according to claim 4, wherein said cleaning member is brought into abutment contact with said image retainer after the end of the final image writing operation, and wherein the release of said cleaning member against and from the abutment against said image retainer is started when no image is being written for forming an image to be transferred.

6. An image forming apparatus according to claim 4, wherein the abutment of said cleaning member against said image retainer is conducted after the end of the final image writing operation, and wherein the release of said cleaning member from the abutment against said image retainer is conducted before the start of the first image writing operation for forming a subsequent toner image.

7. An image forming apparatus according to claim 1, wherein the developing means conducts a non-contact development.

8. In an image forming apparatus for conducting a plurality of writing and developing operations on an image retainer to transfer developed images to a transfer material, comprising:

means for writing an image signal in an image retainer as the image retainer moves in a given direction past a writing position;

a plurality of developing means spaced apart from one another and positioned sequentially along said given direction, each for developing the image retainer having said image signal written thereon with a developer;

a developing-bias power source;

means for sequentially distributing the output of said developing-bias power source to said plurality of developing means in the order in which said image retainer moves along said given direction; and means for transferring a toner image onto a transfer material; and means for cleaning a residual toner on the image retainer.

9. An image-forming apparatus according to claim 8, wherein said developing means have developing sleeves and/or magnet rolls rotating while they are receiving the distributed output of the developing bias power source.

10. An image-forming apparatus according to claim 8, wherein the circumferential length of said image retainer from the writing position over a transfer position to said cleaning member is longer than a maximum expected length of said transfer material.

11. An image forming apparatus according to claim 10, wherein said plurality of developing means includes a plurality of developing devices for accommodating toners of different colors, and wherein said write means and said plurality of developing means operate several times before said transfer to form toner images of plural colors on an image retainer.

12. An image forming apparatus according to claim 11, further comprising motive means to bring said cleaning means into abutment contact with said image retainer after the end of the final image writing operation, and to start release of said cleaning member from abutment against said image retainer when no image is being written for forming an image to be transferred.

13. An image forming apparatus according to claim 11, wherein the motive means brings said cleaning means into abutment against said image retainer after the end of the final image writing operation, and releases said cleaning member from abutment against said image retainer before the start of the first image writing operation for forming a subsequent toner image.

14. An image forming apparatus according to claim 8, wherein the developing means conducts a non-contact development.

15. In an image forming apparatus for conducting a plurality of writing and developing operations on an image retainer to transfer developed images to a transfer material, comprising:

means for writing an image signal in an image retainer as the image retainer moves in a given direction past a writing position;

a plurality of developing means positioned, each for developing the image retainer having said image signal written thereon with a developer;

a developing-bias power source means;

means for sequentially distributing the output of said developing-bias power source to said plurality of developing means;

means for transferring a toner image on a transfer material; and means for cleaning a residual toner on the image retainer including motive means for bringing a cleaning member into abutment contact with said image retainer after the end of the final image writing operation, and to at least start release of said cleaning member from abutment against said image retainer when no image is being written for forming an image to be transferred.

16. An image forming apparatus according to claim 15, wherein said motive means fully releases said cleaning member from abutment against said image retainer before the start of the first image writing operation for forming a subsequent toner image.

17. An image-forming apparatus according to claim 15, wherein the circumferential length of said image retainer from the writing position over a transfer position to said cleaning member is longer than a maximum expected length for said transfer material.

* * * * *